United States Patent [19]

Arsena et al.

[11] Patent Number: 4,959,583

[45] Date of Patent: Sep. 25, 1990

[54] REFLECTIVE LAMPS HAVING AN IMPROVED LIGHT SOURCE MOUNTING ARRANGEMENT

[75] Inventors: Vito J. Arsena, Highland Heights; Harvey C. Clough, Cleveland Heights; Frank E. Zalar, Euclid, all of Ohio

[73] Assignee: General Electric Company, Schenectady, N.Y.

[21] Appl. No.: 331,154

[22] Filed: Mar. 31, 1989

[51] Int. Cl.[5] ..... H01J 61/40; H01J 5/48; H01R 27/00

[52] U.S. Cl. ..... 313/113; 313/318; 313/623; 439/230

[58] Field of Search ..... 313/318, 113, 623, 315; 362/226; 439/230, 271, 276, 935, 936

[56] References Cited

U.S. PATENT DOCUMENTS 3,010,045 11/1961 Plagge et al. ..... 313/318 X
4,456,947 6/1984 Alexander ..... 313/113 X
4,804,878 2/1989 Hough et al. ..... 313/113
4,833,576 5/1989 Mers et al. ..... 362/226
4,855,634 8/1989 Gagnon et al. ..... 313/113

*Primary Examiner*—Sandra L. O'Shea
*Attorney, Agent, or Firm*—John P. McMahon; Stanley C. Corwin; Fred Jacob

[57] ABSTRACT

A structure for supporting a light source within an electric lamp having an internal reflective surfaces of reduced dimensions is disclosed. The structure spatially supports the central portion of the light source relative to the reflective surface and comprises a pair of electrically conductive post which are affixed within openings in the bottom portion of the reflector. Barrier means are provided to prevent a cement substance filling the opening from escaping and entering the inner confines of the reflector lamp. In one embodiment the barrier means for preventing such escape is a washer positioned over each of the post and in another embodiment a glass bead is placed around each of the post to provide such barrier means.

10 Claims, 1 Drawing Sheet

Fig. 1
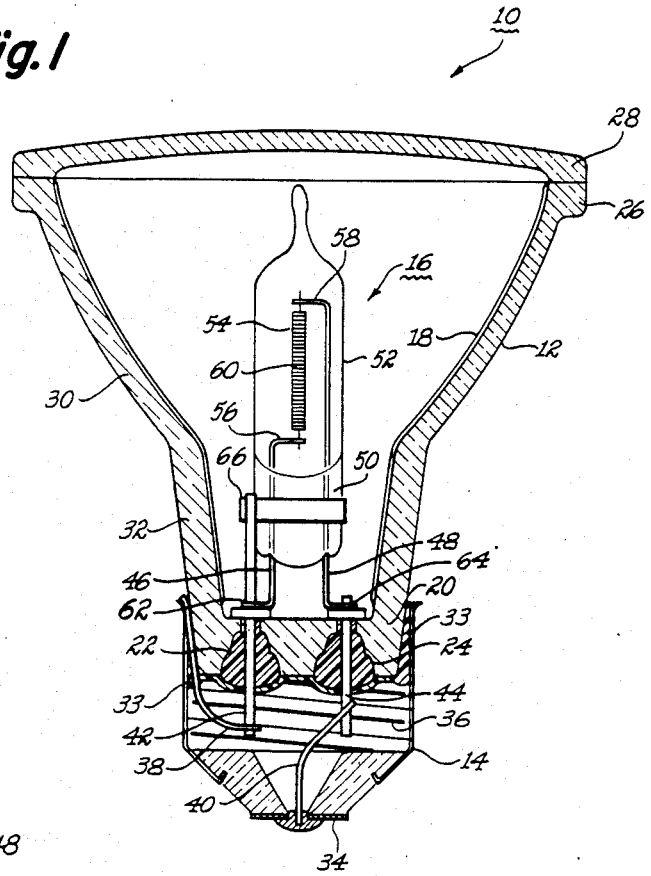
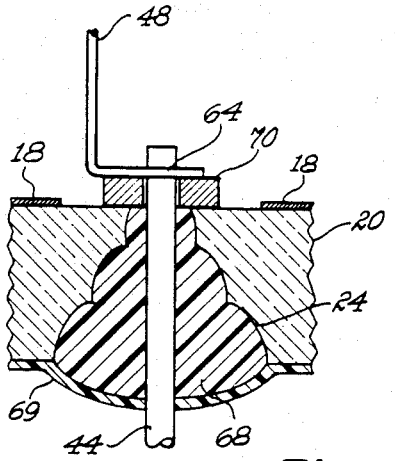
Fig. 2

REFLECTIVE LAMPS HAVING AN IMPROVED LIGHT SOURCE MOUNTING ARRANGEMENT

BACKGROUND OF THE INVENTION

This invention relates to an electric lamp, and more particularly, to a mounting arrangement which allows a tungsten-halogen light source to withstand mechanical shocks and vibrations typically experienced by spot and floodlight lamps having reduced overall dimensions.

Parabolic aluminized reflector (PAR) lamps and lesser efficient, with regard to quality of beam control, reflector (R) lamps both for general spot or floodlighting applications are well known. The PAR and R lamps find applications for short to medium distances outdoors as well as indoors for display, decoration, accent, inspection and downlighting purposes. The common PAR and some R lamps have relatively large dimensions when compared to the common incandescent lamps. Accordingly, the common PAR and some R lamps are commonly housed within relatively large fixtures which, in turn, limit their applications particularly for indoor utilization. It is desired that the PAR and R lamps have reduced overall dimensions while maintaining the precise efficient beam control so as to increase their utilization for indoor applications.

Reducing the overall dimensions of the PAR and R lamps presents certain disadvantages to their utilization. For example, from an optical consideration the reduction in the overall dimensions of these PAR and R lamps reduces the amount of reflective surfaces that are available to direct the transmission of the lumen output of the light source in a forward manner so as to be focused at a desired location or object. The amount of footcandles desired to illuminate a location or object remains the same regardless of the amount of reflective surfaces that may be available.

The amount of lumens available for such illumination is determined by the parameters of the light source being utilized for the reflective lamp. If the amount of lumens desired for an application remains the same, while the overall dimensions of the reflector lamps are reduced, then the wattage should increase and therefore the temperature environment within the lamp is drastically increased and should be taken into account, especially with regard to the temperature capabilities of the components of the lamp.

Reducing the overall dimensions of these lamps must also take into account the parameters of the light source itself and the reduced space available for its electrical connection, electrical isolation and support of the light source within these lamps. The parameters of the light source and the structure for mounting such a light source are interrelated. For example, the dimensions of the outer leads of the light source along with the material of which the leads are composed are interrelated to the rigidity of the structure that is spatially supporting such light sources within reflective lamps. It is desired that structural means be provided that rigidly support a light source while at the same time accommodates the desired elements of the light source along with other parameters of the lamp.

With regards to the electrical considerations related to reflective lamps, the isolation between the internal reflective surfaces of the lamps and the electrical connections for the light source should be provided so that the internal reflective surfaces do not provide a path to allow arcing between the electrically conductive members associated with the light source.

Accordingly, it is an object of the present invention to provide means for securing a light source within a reflective lamp that accommodates the parameters of the light source and lamp itself and in which electrical isolation between the light source and the internal reflective surfaces of the lamp is also provided.

It is a further object of the present invention to provide means for securing a light source within the reflective lamp so that the position of the light source is advantageously located relative to the reflective surfaces allowing a great majority of the available lumens generated by the light source to be directed in a forward manner to an object or location.

SUMMARY OF THE INVENTION

The present invention is directed to a mounting structure that is particularly suited to reflective lamps having reduced overall dimensions while still withstanding the mechanical shocks and vibrations typically experienced by such lamps.

The reflective lamp comprises a reflector, a light source, a base section, a means for electrically connecting the light source, and means for supporting the light source within the reflector. The reflector has internal reflective surfaces and a bottom portion having at least a pair of opening extending therethrough with the opening along with the inner surface of the bottom portion both preferably being devoid of any reflective surface. The base section is affixed to the bottom portion of the reflector. The light source has at least a pair of electrical conductors extending out of its bottom portion which are connected to means for electrically connecting the light source to the base section. The electrical connection means comprises at least a pair of electrically conductive post members extending through the pair of openings. The supporting means predeterminedly position the light source in a rigid manner within the reflector relative to its reflective surface and comprises a hardened cement substance located within the opening and barrier means to substantially prevent the cement substance from entering into the inner confines of the reflector.

The barrier means has various embodiments for preventing the escape of the cement substance which is a somewhat flowable paste before it is solidified by curing.

BRIEF DESCRIPTION OF THE DRAWING

FIG. 1 illustrates one embodiment of electric lamp being of a parabolic aluminized reflector (PAR) type related to the present invention.

FIG. 2 illustrates one embodiment of the structural means of the present invention for mounting the light source within the reflective lamp of FIG. 1.

DETAILED DESCRIPTION OF THE PREFERRED EMBODIMENTS

FIG. 1 illustrates a electric lamp, more particularly, a parabolic aluminized reflector (PAR) lamp 10 in accordance with one embodiment of the present invention. The lamp 10 comprises a reflector 12, a base section 14, and a light source 16.

The reflector 12 has an internal reflective surface 18 which may typically be a silver, aluminum or dichroic type and a bottom portion 20 having at least a pair of opening 22 and 24 extending therethrough with the opening preferably being devoid of any reflective surface 18. It is still further preferred that the inner surface of the bottom portion be devoid of any reflective surface as shown in FIG. 1. The bottom portion preferably has an additional opening (not shown) which serves as an exhaust hole related to filling the inner confines of lamp 10 with a fill-gas. The reflector 12 has a top portion 26 preferably having a lens element 28 affixed thereto.

The reflector 12 has a front portion 30 preferably with a parabolic shape and the intermediate portion 32 having a relatively steep slope. The reflector 12 has features and dimensions that are somewhat different than the common PAR lamps. The fron portion 30 has a diameter at its upper top portion in the range from about 62 mm to about 95 mm, whereas, for common PAR lamps such as PAR 36, PAR 38, and PAR 64 this diameter may have values of 114 mm, 120 mm, and 203 mm respectively.

The base section 14 of FIG. 1 is somewhat different compared to those commonly used with PAR lamps. The base section 14 comprised of an electrical conductive material has a screw thread arrangement which is affixed to the bottom portion 20 of reflector 12 by means of a relatively high-temperature resisting adhesive 33. The electrical connection to the center portion 34 and the side portion 36 both of base section 14 by appropriate means such as solder is provided respectively by electrical conductors 38 and 40 of which conductor 40 is selected to have parameters so as to serve as a fuse element. Conductors 38 and 40 are in turn connected to post members 42 and 44 which are interconnected to the light source 16 in a manner to be described hereinafter.

The light source 16 has at least a pair of electrical conductors 46 and 48 extending out of its bottom portion 50. The light source 16 may have various forms such as a discharge type but is preferably a tungsten-halogen type comprising an envelope 52 containing a fill of a halogen compound and housing an axially aligned preferably coil-coiled tungsten filament 54 having a wide range of wattage ratings which is disposed between inleads 56 and 58. If the outer leads such as conductors 46 and 48 extending out of a light source are relatively thin such as a diameter of about 20 mil so as to facilitate the sealing of these conductors 46 and 48 within the bottom portion 50, then a strap support 66 is needed. If the leads are of larger diameter 40–50 mil, then a strap 66 is not needed.

As discussed in the "Background" section, it is desired that the light source be positioned at its optimum location so that the reflector lamp 10 having a reduced amount of reflective surfaces relative to other reflective lamps may still advantageously direct a sufficient amount of lumens generated by the light source in a forward manner onto an object or location desired to be illuminated. The present invention accomplishes such optimization, by locating the central portion 60 of the filament 54, sometimes referred to as the "light center length" (LCL), at the focal point of the parabolic section 30 of lamp 10. To accomplish such positioning, before the light source 16 is lodged within lamp 10, the inleads 46 and 48, preferably formed of a molybdenum material, are first bent at predetermined locations 62 and 64 and then respectively placed longitudinally along the post members 42 and 44 respectively so that the central portion 60 will be located at the optical focal point of the reflective portion 30 when the light source 16 is inserted into the inner confines of lamp 10. To further supply structural support of light source 16, the post 42 is then fastened to the strap member 66 by appropriate means such as welding.

The positioning of the light source 16 is also dependent upon predeterminedly locating the post members 42 and 44 within the opening 22 and 24 respectively, so that the LCL of the filament corresponds to the focal point of the parabolic section when light source is housed in lamp 10. The positioning of the post members within their respective opening and maintaining such positioning in spite of harsh temperature conditions along with mechanical shocks and vibrations is of importance to the present invention.

As discussed in the "Background" section, the means for spatially disposing the light source within the electric lamp should not only take into account the harsh temperature environment but also the parameters of the light source and the lamp itself. The present invention provides a structure that rigidly holds the light source in place while at the same time accommodating the parameters of the post members, the glass reflector and protecting the inner confines of the lamp from the entrance of contaminants. The structural means of the present invention may be described with reference to FIG. 2.

FIG. 2 shows the opening 24 having post member 44 located which showing and description to be given for FIG. 2 is also applicable to opening 22 and post member 42 along with the sealing of the exhaust hole with the cement substance to be described after the previously mentioned filling of the lamp 10 with a fill-gas is accomplished. The post members 42 and 44 are relative thick conductors having a diameter in the range from about 0.5 mm to about 2 mm but are preferably in the range of about 1 mm to about 1.5 mm. The post member 44 is affixed within opening 24 by means of an electrically insulating cement substance 68 which preferably has high temperature capabilities and may be of the substance described in U.S. patent application Ser. No. 101,929, now U.S. Pat. No. 4,833,576, of Arsena et al., filed during September 1987, assigned to the same assignee as the present invention and herein incorporated by reference. The substance 68 of U.S. patent application Ser. No. 101,929, now U.S. Pat. No. 4,833,576, may be cured by heat at a temperature of about 350° C. for a duration of about 10 minutes so as to obtain its adhesive and cohesive properties state that it maintains even when subjected to temperature in the range from about 300° C. to about 350° C. which may be typically experience by a lamp 10 having reduced overall dimensions. Before it reaches its hardened state, the cement substance 68 is prevented from escaping opening 24 and entering the inner confines of lamp 10 by barrier means 70.

The cement substance 68 allows for variations in the dimensions of the post members 42 and 44 in that all that is necessary is for the post members to have an outer dimension to allow their insertion into the openings. After such insertion, the post members are held in place so that the LCL of filament 54 is located at the focal point of the front section until the cement substance obtains its hardened state. The cement substance forming part of the structural means of the present invention accommodates the glass reflector by having a coefficient of expansion that substantially matches that of the glass of the reflector 12 and thereby prevents any fracturing of the glass by the structural means. Still further, the cement substance 68 removes any voids at the bottom of the lamp, which includes the exhaust hole, that would otherwise allow contaminants to enter the inner confines of the lamp. Further still, the cement substance 68 after it obtains its hardened state will not re-soften or become electrically conductive when exposed to high humidity conditions.

If desired, a coating 69 may be placed over the bottom portion of cement 68 so as to create an hermetic seal for PAR lamp 10. While silicones have been shown to be effective for preventing moisture from entering the lamp 10, they are somewhat limited because these materials emit constituents that can disadvantageously deposit on the reflective surface of the lamp 10.

The barrier means 70 of FIG. 2 in one embodiment is in the form of a washer that is placed over and around post member 44 prior to its insertion into the opening 24. The washer contacts the inner surface of the reflector in a flush-like manner and prevents the cement substance 68 from entering the inner confines of lamp 10. The cement substance 68 is a somewhat flowable paste before it is solidified by heating giving rise to the need of barrier means 70. The washer 70 may be of an insulative material so as to provide electrical isolation between the reflective surface 18 and the conductive post 44. Conversely, the washer 70 may be of a metallic substance if, and in accordance with the preferred embodiment, the top portion of opening 24 is devoid of any electrically conductive reflective surface. Still further, the barrier means 70 may be in the form of a glass bead placed over and around post member 44 and provides the equivalent insulative function as the insulating washer 70. Further still, the barrier means 70 may be a single piece arrangement that spans between and covers both openings 22 and 24.

As discussed in the "Background" section, it is important that electrical isolation be maintained between the light source and the reflective surfaces of the lamp so that the reflective surfaces do not provide a path that would allow arcing between, for example, post members 42 and 44 carrying current to the light source 16.

In accordance with the practice of the present invention, at least 15 lamps having the benefits hereinbefore described were subjected to lamp performance testing which subjected these lamps to various conditions to qualify their entrance into commercial implementation. All of the lamps encountered such conditions without experiencing any failures.

It should now be appreciated that the practice of the present invention provides for structural means for securing and spatially positioning a light source at an optimum location within a reflective lamp having reduced dimensions so as to effectively utilize the lumens generated by the light source. Further, the invention provides for electrical isolation of the light source relative to the reflective surface of the lamp 10.

Although the electrical and structural arrangements for the light source 16 was described as comprising a two-piece configuration of the post members 42 and 44 respectively connected to the outer leads 46 and 48, if desired such arrangements may comprise a single configuration in which the outer leads 46 and 48 are located within the openings 22 and 24, respectively, and are rigidly supported by the cement substance 68. For such a single configuration it is preferred that the diameter of the outer leads 46 and 48 be in the range from about 0.5 mm to about 1.5 mm.

What we claim as new and desire to secure by Letters Patent of the U.S. is:

1. An electric lamp comprising:

(a) a reflector having an internal electrically conductive reflective surface and a bottom portion having at least a pair of openings extending therethrough;

(b) a base section affixed to said bottom portion of said reflector;

(c) a light source having at least a pair of electrical conductors extending out of its bottom portion;

(d) means for electrically connecting said electrical conductors of said light source to said base section comprising at least a pair of electrically conductive post members extending through said openings and connected to said pair of electrical conductors; and (e) means consisting of a cement substance within said openings for solely and spatially disposing said light source within said reflector and a barrier means within said openings to prevent said cement substance from entering the inner confines of said reflector.

2. An electric lamp according to claim 1 further comprising a lens element affixed to the top portion of said reflector.

3. An electric lamp according to claim 1 wherein said openings each have a top portion which is devoid of said electrically conductive reflective surface.

4. An electric lamp according to claim 1 wherein the top surface of said bottom portion is devoid of said electrically conductive reflective surface.

5. An electric lamp according to claim 1 wherein said pair of electrical conductors are connected to said pair of post members at respective location so that the central portion of said light source is located at the optical focal point of the reflective surface of the reflector.

6. An electric lamp according to claim 1 wherein said barrier means is a washer positioned over and around its respective post member and making contact with the inner surface of said reflector.

7. An electric lamp comprising:

(a) a reflector having an internal electrically conductive reflective surface and a bottom portion having at least a pair of openings extending therethrough;

(b) a base section affixed to said bottom portion of said reflector;

(c) a light source having at least a pair of electrical conductors extending out of its bottom portion;

(d) means for electrically connecting said electrical conductors of said light source to said base section comprising at least a pair of electrically conductive post members extending through said openings and connected to said pair of electrical conductors, said pair of electrical conductors being connected to said pair of post members at respective locations so that the central portion of said light source is located at the optical focal point of the reflective surface of the reflector; and (e) means for spatially disposing said light source within said reflector comprising a cement substance within said openings and a washer serving as a barrier means to prevent said cement substance from entering the inner confines of said reflector, said washer being of an electrically insulative material.

8. An electric lamp comprising:

(a) a reflector having an internal electrically conductive reflective surface and a bottom portion having at least a pair of openings extending therethrough;

(b) a base section affixed to said bottom portion of said reflector;

(c) a light source having at least a pair of electrical conductors extending out of its bottom portion;

(d) means for electrically connecting said electrical conductors of said light source to said base section comprising at least a pair of electrically conductive post members extending through said openings and connected to said pair of electrical conductors, said pair of electrical conductors being connected to said pair of post members at respective locations so that the central portion of said light source is located at the optical focal point of the reflective surface of the reflector; and (e) means for spatially disposing said light source within said reflector comprising a cement substance within said openings and a glass bead serving as a barrier means to prevent said cement substance from entering the confines of said reflector, said glass bead being positioned over and around its respective post member and making contact with the inner surface of said reflector.

9. An electric lamp (according to claim 1) comprising:

(a) a reflector having an internal electrically conductive reflective surface and a bottom portion having at least a pair of openings extending therethrough;

(b) a base section affixed to said bottom portion of said reflector;

(c) a light source having at least a pair of electrical conductors extending out of its bottom portion;

(d) means for electrically connecting said electrical conductors of said light source to said base section comprising at least a pair of electrically conductive post members extending through said openings and connected to said pair of electrical conductors, said pair of electrical conductors being connected to said pair of post members at respective locations so that the central portion of said light source is located at the optical focal point of the reflective surface of the reflector; and (e) means for spatially disposing said light source within said reflector comprising a cement substance within said openings and a barrier means to prevent said cement substance from opening the inner confines of said reflector, said cement substance having a bottom portion not contacting said barrier means and exposed to said base section and wherein said bottom portion has a coating thereon which prevents moisture from entering the inner confines of said reflector by way of said openings.

10. An electric lamp according to claim 9 wherein said coating is of a sealing material.

* * * * *